US010249192B2

(12) United States Patent
Wittorf et al.

(10) Patent No.: US 10,249,192 B2
(45) Date of Patent: Apr. 2, 2019

(54) NOTIFICATION REGARDING AN ESTIMATED MOVEMENT PATH OF A VEHICLE

(71) Applicant: GM GLOBAL TECHNOLOGY OPERATIONS LLC, Detroit, MI (US)

(72) Inventors: Marten Wittorf, Ingelheim (DE); Peter Kahler, Nierstein (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/901,977

(22) Filed: Feb. 22, 2018

(65) Prior Publication Data

US 2018/0240340 A1 Aug. 23, 2018

(30) Foreign Application Priority Data

Feb. 22, 2017 (DE) ..... 10 2017 001 707

(51) Int. Cl.
*G08G 1/123* (2006.01)

(52) U.S. Cl.
CPC ..... *G08G 1/123* (2013.01)

(58) Field of Classification Search
None
See application file for complete search history.

(56) References Cited

U.S. PATENT DOCUMENTS 5,483,453 A * 1/1996 Uemura ..... G05D 1/0246 180/179
5,793,329 A * 8/1998 Nakada ..... G01V 3/12 342/357.53
5,899,954 A * 5/1999 Sato ..... G01C 22/02 340/988
6,546,336 B1 * 4/2003 Matsuoka ..... G01C 22/006 701/408
8,457,892 B2 * 6/2013 Aso ..... B60W 30/10 701/400
2002/0032035 A1 * 3/2002 Teshima ..... G06Q 30/02 455/456.3
2003/0195704 A1 * 10/2003 Sekiguchi ..... B60W 30/16 701/301
2006/0095193 A1 * 5/2006 Nishira ..... B60T 7/22 701/96

(Continued)

*Primary Examiner* — Fekadeselassie Girma
(74) *Attorney, Agent, or Firm* — Lorenz & Kopf, LLP

(57) ABSTRACT

A system and method provide notification regarding an estimated movement path of a vehicle. A first vehicle includes an identification feature. A second vehicle includes an identification feature detection unit, an output unit and a transmission unit. A heuristic unit is configured to determine an estimation of an imminent movement path of the first vehicle. A position detection unit is configured to detect a current position of the first vehicle and/or the second vehicle and to transmit the detected current position to the heuristic unit. The identification feature detection unit is configured to detect and transmit the identification feature to the heuristic unit via the transmission unit. The heuristic unit is configured to transmit the current estimation for the first vehicle to the output unit via the transmission unit. The output unit is configured to communicate the estimation to a driver of the second vehicle.

19 Claims, 2 Drawing Sheets

(56) References Cited

U.S. PATENT DOCUMENTS

| | | | | |
|---|---|---|---|---|
| 2008/0249688 | A1* | 10/2008 | Sawamoto | B60K 31/0008 701/48 |
| 2009/0012703 | A1* | 1/2009 | Aso | B60W 30/10 701/532 |
| 2014/0200799 | A1* | 7/2014 | Sugano | B62D 15/027 701/301 |
| 2015/0029042 | A1* | 1/2015 | Ikeya | G08G 1/052 340/934 |
| 2015/0100228 | A1* | 4/2015 | Sudou | G01S 1/02 701/300 |
| 2016/0229399 | A1* | 8/2016 | Wada | B60W 30/12 |
| 2017/0028917 | A1* | 2/2017 | Tauchi | G08G 1/165 |
| 2017/0069214 | A1* | 3/2017 | Dupray | G08G 5/0021 |
| 2017/0132852 | A1* | 5/2017 | Morita | G07C 5/008 |
| 2017/0148327 | A1* | 5/2017 | Sim | G08G 1/167 |
| 2017/0168481 | A1* | 6/2017 | Flanigan | G05D 1/0022 |
| 2017/0343799 | A1* | 11/2017 | Ito | G02B 27/0093 |
| 2018/0022351 | A1* | 1/2018 | Habu | B60W 30/12 701/96 |
| 2018/0045516 | A1* | 2/2018 | Sumizawa | G01C 21/28 |
| 2018/0167558 | A1* | 6/2018 | Hirai | H04N 5/23254 |
| 2018/0201271 | A1* | 7/2018 | Ishioka | B60W 30/10 |
| 2018/0240340 | A1* | 8/2018 | Wittorf | G08G 1/123 |
| 2018/0284787 | A1* | 10/2018 | Naka | G05D 1/0088 |

* cited by examiner

NOTIFICATION REGARDING AN ESTIMATED MOVEMENT PATH OF A VEHICLE

CROSS-REFERENCE TO RELATED APPLICATION

This application claims priority to German Patent Application No. 102017001707.7, filed Feb. 22, 2018, which is incorporated herein by reference in its entirety.

TECHNICAL FIELD

The present disclosure pertains to a system and to a method for outputting an estimation of an imminent movement path of a first vehicle to a driver of a second vehicle.

BACKGROUND

A challenge of the individual traffic is that a road user only has at his disposal a fraction of information regarding the intentions of another road user. For this purpose, motorized vehicles frequently have travelling direction indicators. Such travelling direction indicators however cannot adequately reflect the intentions of another road user in all situations.

SUMMARY

The present disclosure provides a system and method to increase the road traffic safety and in particular facilitate assessing the current traffic situation. According to a first aspect of the present disclosure, a system includes a first vehicle with an identification feature, a second vehicle with an identification feature detection unit and a transmission unit, a heuristic unit configured to determine an estimation of an imminent movement path of the first vehicle, an output unit, and a position detection unit configured to detect a current position of the first vehicle and/or of the second vehicle and to transmit the detected current position to the heuristic unit. The identification feature detection unit is transmits the identification feature to the heuristic unit via the transmission unit and the heuristic unit is configured to transmit the current estimation for the first vehicle to the output unit via the transmission unit. Furthermore, the output unit is configured to output the estimation to a driver of the second vehicle.

The vehicle, in particular the first and the second vehicle, may be a car, commercial vehicle, bus, bicycle, stroller, electric scooter, agricultural machine, construction vehicle, rail vehicle, water craft (e.g., ship), submarine, or an aircraft. The system may be extended to other objects instead of the first vehicle, in particular a pedestrian, a robotic unit, an autonomous or network-controlled device (e.g., an active lane boundary or lane expansion). When the "vehicle" is extended to other objects instead of the first vehicle, these objects preferably have in common that they include an identification feature.

The heuristic unit is configured to determine a probabilistic estimation of a future movement path of the first vehicle. In the process, suitable probability theories and distributions are employed, which among other things can be supported by an artificial neural network. The artificial neural network, in particular, is trained by values in the past. This process can take place in the form of an off-line training. However, when current values support the estimation, the probabilistic estimation assumes traits of an on-line training. Furthermore, a Bayes' theorem or approach is applied. In other words, the heuristic unit is a processing unit which outputs an estimation for a future movement path of the first vehicle based on empirically accumulated information. The heuristic methods carried out on the heuristic unit advantageously determine a probable movement path of the first vehicle with low computational power. In particular, evolutionary and genetic algorithms are part of the heuristic methods. However, a multiplicity of methods from the major field of artificial intelligence and non-linear optimization may be generally applied.

The position detection unit together with the heuristic unit is preferably arranged in a central processing unit. Alternatively preferred or preferred in combination thereto, the position detection unit is a position detection unit of the first vehicle configured to transmit a currently detected position of the first vehicle to the central processing unit. The purpose of the position detection unit is that the heuristic unit has at its disposal a position information for at least the first vehicle (which under certain conditions is also approximately determinable from the position of the second vehicle), in order to determine the respective future imminent movement path of the first vehicle.

The identification feature of the first vehicle is a feature which uniquely identifies the first vehicle from a plurality of other vehicles. In particular, the identification feature detection unit may include a camera, lidar, radar.

The identification feature detection unit is configured to detect and also recognize exactly this identification feature. Thus, the identification feature detection unit constitutes a suitable means for detecting and for recognizing the identification feature.

In particular, the identification feature detection unit is configured to compare the detected identification feature in a data comparison with reference objects and/or reference situations in an expanded network when an allocation of the identification feature to the respective first vehicle by the identification feature detection unit and/or the heuristic unit has not yet taken place or is not possible. An advantageous effect of the present disclosure is that road traffic safety is improved and a current estimation of another road user is substantially facilitated for a driver of a vehicle.

According to an advantageous embodiment, the first vehicle further includes a vehicle locating unit configured to detect the position of the first vehicle and a transmission unit configured to transmit the detected position of the first vehicle to the heuristic unit.

The vehicle locating unit may include a satellite-based locating unit which improves the precision of a positioning of the vehicle utilizes additional sensor technology, which preferably includes one or more of the following elements: magnetic sensor, inertial measurement unit ("IMU"), satellite navigation system (e.g., NAVSTAR-GPS, GLONASS, Galileo, BeiDou, or IRNSS/NAVIC), camera for detecting an optical flow of a surroundings of the camera, a camera with image detection function for comparison with a digital map, or WLAN-locating unit for assigning a WLAN source to a position of the WLAN source. This sensor technology passes the respective data for the location of the vehicle on to a digital map. Data from different sensors are combined by data fusion to form an improved estimation of a determined vehicle position. This process preferably takes place with the help of a Kalman filter to filter jumps and noise up to a predefined bandwidth and introduce a certain inertia into the consolidated estimation of the current vehicle position. An analogous procedure or near-analogous procedure may be employed for determining a current orientation of the vehicle. The orientation of the vehicle is determined by an azimuth or yaw, or by the orientation of a longitudinal axis of the vehicle. Furthermore, an inclination or pitch angle of the vehicle and a roll angle of the vehicle can be determined. While an azimuth or yaw angle of the vehicle describes an angle of the longitudinal axis of the vehicle lying in a horizontal plane relative to north, the inclination or pitch angle indicates an inclination of the longitudinal axis of the vehicle relative to the horizontal plane. Accordingly, the roll angle of the vehicle describes an angle which materializes by the rolling of the vehicle about this longitudinal axis, respectively a projection of the longitudinal axis onto the horizontal plane compared with the horizontal plane. By way of all three angles, the yaw angle, the pitch angle and the roll angle of the vehicle (also called Euler angles), an orientation of the vehicle is completely described. Alternatively to Euler angles, reference to a quaternion description may be used should possible singularities during calculations in the coordinate transformation to another reference system occur. The transmission unit transmits the respective data preferably via a mobile radio network. The position detection unit is the vehicle locating unit of the first vehicle.

According to a further advantageous embodiment, the first vehicle further includes a navigation system with an active routing to a predetermined destination position and a transmission unit configured to transmit the routing to the heuristic unit. The prediction quality of the heuristic unit can thereby be increased.

According to a further advantageous embodiment, the identification feature includes at least one of the following elements: a shape of the first vehicle; a color scheme of the first vehicle; a movement pattern of the first vehicle; an optically readable characteristic mark; an electromagnetically readable characteristic mark; or an identification signal sent out from the first vehicle. The term "movement pattern" includes the intrinsic dynamism of a cyclist or of a driver of a personal transporter. The color scheme of the first vehicle relates to a pattern that is characteristic for the vehicle and preferably individual with respective colors. The electromagnetically readable characteristic mark may be an RFID chip.

In particular, the identification feature may include a color change of the first vehicle, a shaping of the first vehicle, a vehicle type of the first vehicle, characteristic changes in shaping of the first vehicle, a size of the first vehicle, a movement pattern of the first vehicle recognized in the past (in particular a direction or a speed of the first vehicle, or a movement path within the first vehicle), a light signal of the first vehicle (preferably a static/time-invariant light signal or a clocked/controlled light signal), a characteristic light reflection of the first vehicle, an acoustic signal of the first vehicle (in an audible and/or non-audible frequency range), a characteristic material of the first vehicle, or a combination of the identification features mentioned above.

According to a further advantageous embodiment, the identification signal is a light signal. This light signal is characterized in particular by a characteristic and unique radiation pattern over the course of time of the light signal. By way of this it is advantageously achieved that a signal which is not recognizable for the human eye is recognized by the identification feature detection unit.

According to a further advantageous embodiment, the heuristic unit is arranged in a central processing unit, for example a server. The heuristic unit is configured to support the estimation by at least one of the following elements: a statistical evaluation of the routes travelled by the first vehicle in the past; a current routing of a navigation system of the first vehicle; or a calendar entry in an electronic device of a driver of the first vehicle.

According to a further advantageous embodiment, the output unit is a head-up display of the second vehicle. The output unit may be a monitor of the second vehicle.

According to a further advantageous embodiment, the output unit is an electroacoustic transducer of the second vehicle. Preferably, the electroacoustic transducer of the second vehicle is a loudspeaker of the second vehicle.

According to a further advantageous embodiment, the output unit is a car-to-X communication device of the first vehicle. This car-to-X communication device may be an electroacoustic car-to-X communication device such as a horn or a device configured to transmit a light signal to the second vehicle in order to alert the driver of the second vehicle to a danger.

According to a further advantageous embodiment, the output unit is a control unit of the first vehicle, and the second vehicle includes an autopilot. The control device is configured to transmit a control signal to the autopilot of the second vehicle. Advantageously, driving parameters, a route guidance or other sub-systems of the autopilot of the second vehicle are thus influenced.

According to a further advantageous embodiment, the transmission unit is configured to transmit the respective data to be transmitted in an encrypted and/or anonymous manner.

In particular anonymization can be achieved by way of IP cascades of anonymization network for example "TOR", as a result of which the source of the identification feature, i.e. the respective sender (first vehicle) is impossible to detect for a receiver. Furthermore, an encryption of the data serves to prevent an attacker from gaining access to personal data of the respective sender, i.e. of the first vehicle. In particular, data protection is advantageously supported in this embodiment.

A further aspect of the present disclosure relates to a method for outputting an estimation of an imminent movement path of a first vehicle with an identification feature to a driver of a second vehicle. In a first step, a current position of the first vehicle and/or of the second vehicle is detected and the detected current position is transmitted to a heuristic unit by a position detection unit. The identification feature is detected by an identification feature detection unit of the second vehicle. The identification feature is transmitted to the heuristic unit by a transmission unit of the second vehicle. An imminent movement path of the first vehicle is estimated and the current estimation is transmitted to an output unit of the second vehicle by the transmission unit. Finally, the current estimation is output to a driver of the second vehicle by the output unit.

Advantages and preferred further developments of the proposed method are obtained by an analogous and corresponding of the explanations made above in connection with the proposed device.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
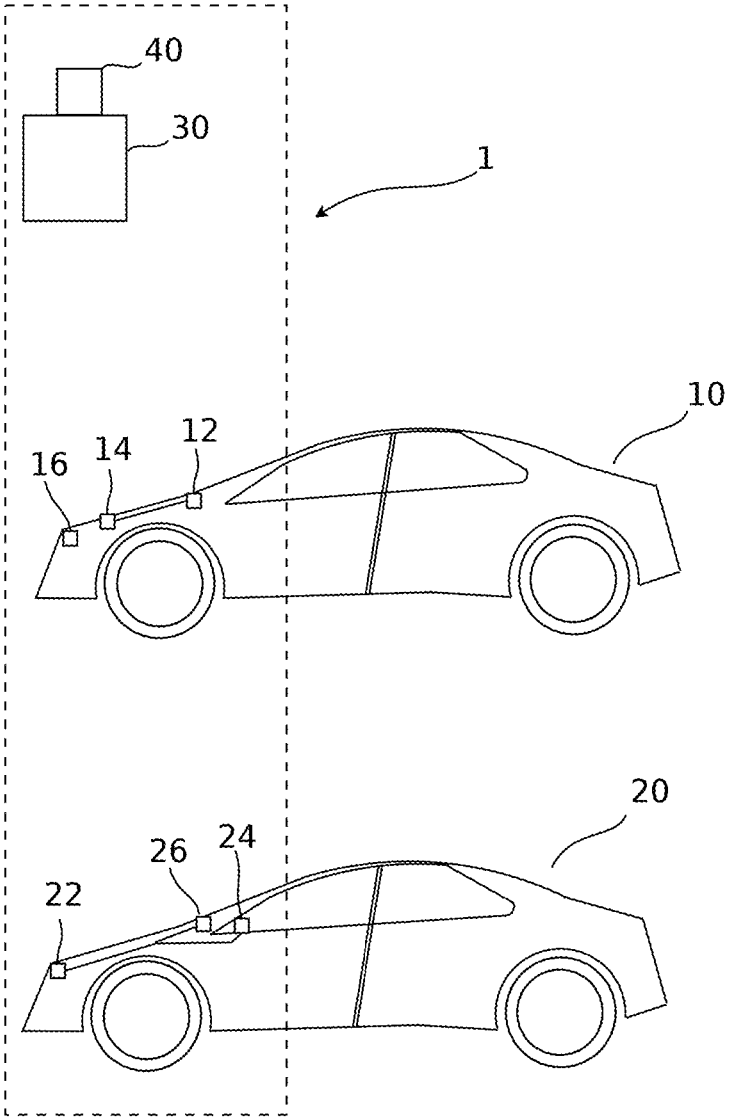
FIG. 1 shows a system for outputting an estimation of an imminent movement path of a first vehicle according to an exemplary embodiment of the present disclosure.

FIG. 1 shows a system 1 for outputting an estimation of an imminent movement path of a first vehicle 10. The system 1 includes a first vehicle 10 with an identification feature and a second vehicle 20 with an identification feature detection unit 22 with an output unit 24, and with a transmission unit 26. A heuristic unit 30 is configured to determine an estimation of an imminent movement path of the first vehicle 10. A position detection unit 40 is configured to detect a current position of the first vehicle 10 and/or of the second vehicle 20 and to transmit the detected current position to the heuristic unit 30.

The identification feature is a light signal emitted by a lighting system of the first vehicle 10 with a unique pattern of a sequence of the states of the lighting system "light on" and "light off" contained therein. The heuristic unit 30 is a system on a central server, and the position detection unit 40 is an analysis module which determines the position (e.g., by radio cell tracking) from which the second vehicle 20 sends an enquiry to the central server 30 via the transmission unit 26. This enquiry includes at least the question as to which currently imminent movement path the first vehicle 10 will probably take. The identification detection unit 22 to this end detects the abovementioned identification feature and transmits the same to the heuristic unit 30 via the transmission unit 26. The heuristic unit 30 determines an estimation of the imminent movement path of the first vehicle 1 from destination data of the first vehicle 10. Thus, the heuristic unit 30 is provided with clues as to the possible destination of the driver of the first vehicle 10. The destination data may be extracted from calendar data of a Smartphone of the driver of the first vehicle 10. The destination data may be extracted from a navigation system the imminent movement path of a hypothetical routing calculated by the heuristic unit 30 itself. Following this, the heuristic unit 30 transmits the current estimation of the imminent movement path of the first vehicle 10 to the output unit 24 of the second vehicle 20 via the transmission unit 26. The output unit 24 of the second vehicle 20 may be a monitor or display of the second vehicle 20. On this output unit 24, the estimation of the heuristic unit 30 is displayed for a driver of the second vehicle 20.

Figure 2:
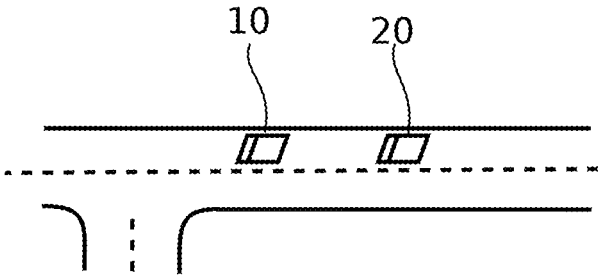
FIG. 2 shows a traffic situation, in which a system for outputting an estimation of an imminent movement path of a first vehicle according to a further exemplary embodiment of the present disclosure is employed.

FIG. 2 shows a typical traffic situation in which the second vehicle 20 travels behind the first vehicle 10 on a road. To the driver of the rear second vehicle 20 it can be of decisive importance to correctly assess the imminent movement path of the first vehicle 10. For example, if the first vehicle 10 will travel straight ahead or turn to the left at the shown intersection. This is where the system 1 is applied. The system 1 in turn includes the first vehicle 10 with an identification feature, the second vehicle 20 with an identification feature detection unit 22, an output unit 24, a transmission unit 26, and a heuristic unit 30 which is configured to determine an estimation of the imminent movement path of the first vehicle 10. Furthermore, the system 1 includes a position detection unit 40 that serves to detect a current position of the first vehicle 10 and/or of the second vehicle 20 and to transmit the detected current position to the heuristic unit 30. An identification feature is a vehicle characteristic mark of the first vehicle 10. The heuristic unit 30 is a system on a central server. The position detection unit 40 is a vehicle locating unit 12 for detecting the position of the first vehicle 10. The detected position is transmitted to the heuristic unit 30 via a transmission unit 14 of the first vehicle 10. The identification feature detection unit 22 of the second vehicle 20 to this end includes a vehicle characteristic mark (e.g., number plate) of the first vehicle 10 and transmits the same to the heuristic unit 30 via the transmission unit 26. The heuristic unit 30 may be aware of a planned movement path of the first vehicle 10 from a navigation system 16 of the first vehicle 10 by way of active routing to a predetermined destination position. This routing is transmitted to the heuristic unit 30 via a transmission unit 14. Following this, the heuristic unit 30 transmits the current estimation of the imminent path of the first vehicle 10 to the output unit 24 of the second vehicle via the transmission unit 26. The output unit 24 of the second vehicle 20 may be a head-up display of the second vehicle 20. On the output unit 24, the estimation of the heuristic unit 30 is displayed to a driver of the second vehicle 20.

Figure 3:
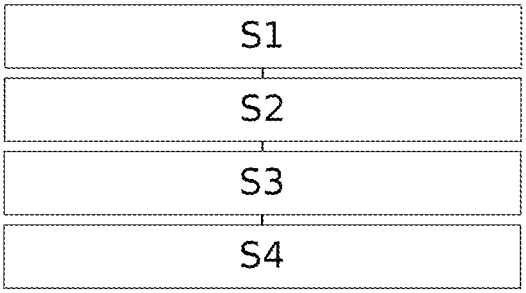
FIG. 3 shows a method for outputting an estimation of an imminent movement path of a first vehicle according to a further exemplary embodiment of the present disclosure.

FIG. 3 shows a method for outputting an estimation of an imminent movement path of a first vehicle 10 with an identification feature to a driver of a second vehicle 20. A current position of the first vehicle 10 and/or of the second vehicle 20 is detected, and the detected current position is transmitted to a heuristic unit 30 by a position detection unit 40 at block S1. The identification feature is detected by an identification feature detection unit 22 of the second vehicle 20 and the identification feature is transmitted to the heuristic unit 30 by a transmission unit 26 of the second vehicle 20 at block S2. An imminent movement path of the first vehicle 10 is estimated and the current estimation is transmitted to an output unit 24 of the second vehicle 20 via the transmission 26 of the second vehicle 20 at block S3. The current estimation is communicated to a driver of the second vehicle 20 by the output unit 24 at block S4.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment as contemplated herein. It should be understood that various changes may be made in the function and arrangement of elements described in an exemplary embodiment without departing from the scope of the invention as set forth in the appended claims.

What is claimed is:

1. A system comprising:

a first vehicle having an identification feature configured to uniquely identify the first vehicle, and having a vehicle locating unit configured to estimate a current vehicle position of the first vehicle, and having a first transmission unit configured to transmit the current vehicle position;

a processing unit that has a heuristic unit configured to determine a current estimation of an imminent movement path of the first vehicle;

a position detection unit remote from the first vehicle and configured to detect the current vehicle position of the first vehicle as transmitted by the first transmission unit and to transmit the current vehicle position to the heuristic unit; and a second vehicle including an identification feature detection unit configured to detect the identification feature of the first vehicle, a second transmission unit and an output unit, wherein the identification feature detection unit is configured to detect and transmit the identification feature to the heuristic unit by the second transmission unit;

wherein the heuristic unit is configured to transmit the current estimation of the imminent movement path of the first vehicle to the second transmission unit;

wherein the second transmission unit is in communication with the output unit which is configured to communicate the current estimation of the imminent movement path of the first vehicle to a driver of the second vehicle, wherein the driver of the second vehicle is alerted to the current estimation of the imminent movement path of the first vehicle.

2. The system according to claim 1, wherein the position detection unit is configured to detect a current second vehicle position of the second vehicle and to transmit the current second vehicle position to the heuristic unit.

3. The system according to claim 1, wherein the identification feature comprises at least one of the following elements:

a shape of the first vehicle;

a color scheme of the first vehicle;

a movement pattern of the first vehicle;

an optically readable characteristic mark;

an electromagnetically readable characteristic mark; and an identification signal emitted by the first vehicle.

4. The system according to claim 3, wherein the identification signal comprises a light signal.

5. The system according to claim 1, wherein the heuristic unit is remote from both the first and second vehicles.

6. The system according to claim 5, wherein the heuristic unit is configured to estimate the imminent movement path of the first vehicle by a statistical evaluation of the routes traveled by the first vehicle in the past.

7. The system according to claim 5, wherein the heuristic unit is configured to estimate the imminent movement path of the first vehicle by a current routing of a navigation system of the first vehicle.

8. The system according to claim 5, wherein the heuristic unit is configured to estimate the imminent movement path of the first vehicle by a calendar entry in an electronic device of a driver of the first vehicle.

9. The system according to claim 1, wherein the output unit comprises a head-up display of the second vehicle.

10. The system according to claim 1, wherein the output unit comprises a display of the second vehicle.

11. The system according to claim 1, wherein the output unit comprises an electroacoustic transducer of the second vehicle.

12. The system according to claim 1, further comprising a communication device of the first vehicle configured to communicate to external entities via a transmitted signal.

13. The system according to claim 1, further comprising a control unit of the first vehicle and an autopilot of the second vehicle, wherein the control unit is configured to transmit a control signal to the autopilot of the second vehicle.

14. The system according to claim 1, wherein the first transmission unit is configured to provide encrypted transmissions.

15. The system according to claim 1, wherein the first transmission unit is configured to provide transmissions in an anonymous manner.

16. A system comprising:

a first vehicle including an identification feature, a first transmission unit and a vehicle locating unit configured to estimate a current vehicle position of the first vehicle;

a heuristic unit configured to estimate an imminent movement path of the first vehicle;

a position detection unit configured to detect the current vehicle position of the first vehicle and to transmit the current vehicle position to the heuristic unit; and a second vehicle including an identification feature detection unit for detecting the identification feature of the first vehicle, a second transmission unit and an output unit, wherein the identification feature detection unit is configured to detect and transmit by the second transmission unit, the identification feature to the heuristic unit;

wherein the first vehicle has a navigation system with an active routing to a predetermined destination position;

wherein the first transmission unit is configured to transmit the active routing to the heuristic unit;

wherein the heuristic unit is configured to transmit the imminent movement path of the first vehicle to the second transmission unit which is in communication with the output unit for communicating the current estimation to a driver of the second vehicle, wherein the driver of the second vehicle is alerted to the current estimation of the imminent movement path of the first vehicle.

17. A method for outputting an estimation of an imminent movement path of a first vehicle to an output unit of a second vehicle comprising:

identifying, by a vehicle locating unit of the first vehicle, a current position of the first vehicle;

transmitting, by the first vehicle via a first transmission unit, the current position;

detecting, by a position detection unit located remote from the first vehicle, the current position of of the first vehicle as transmitted by the first transmission unit;

transmitting, by the position detection unit, the current position to a heuristic unit;

transmitting, by the first transmission unit, an identification feature of the first vehicle;

detecting, by an identification feature detection unit of the second vehicle, the identification feature of the first vehicle;

transmitting, by the second vehicle via a second transmission unit, the identification feature of the first vehicle to the position detection unit;

transmitting, by the position detection unit, the identification feature to the heuristic unit;

estimating, by the heuristic unit, a current estimation of the imminent movement path of the first vehicle;

transmitting, by a second transmission unit, the current estimation to the output unit of the second vehicle; and displaying, by the output unit and to a driver of the second vehicle, the current estimation.

18. The method of claim 17, comprising:

recording, by a navigation system, an active routing to a predetermined destination position;

transmitting, by the first transmission unit the active routing to the heuristic unit; and calculating, by the heuristic unit using the active routing, the imminent movement path.

19. The method according to claim 17, wherein estimating the current estimation of the imminent movement path of the first vehicle further comprises estimating, by the heuristic unit, the imminent movement path of the first vehicle by a calendar entry in an electronic device of a driver of the first vehicle.

* * * * *